US005165659A

United States Patent [19]

L'Heureux

[11] Patent Number: 5,165,659

[45] Date of Patent: Nov. 24, 1992

[54] ROOF OPENER AND METHOD FOR THE VENTING OF STRUCTURES BY FIRE FIGHTERS

[76] Inventor: Leo R. L'Heureux, 352 Pool Rd., Biddeford, Me. 04005

[21] Appl. No.: 813,106

[22] Filed: Dec. 23, 1991

[51] Int. Cl.[5] ..... B25B 1/04

[52] U.S. Cl. ..... 254/17; 254/131

[58] Field of Search ..... 254/1, 17, 11, 131, 254/133 R

[56] References Cited

U.S. PATENT DOCUMENTS

| | | | |
|---|---|---|---|
| 195,412 | 9/1877 | Spurr et al. | 254/131 |
| 624,147 | 5/1899 | Allen | 254/17 |
| 1,270,970 | 7/1918 | Rich | 254/131 |
| 1,375,751 | 4/1921 | Grannis | 254/131 |
| 1,559,976 | 11/1925 | Ness | 254/131 |
| 3,362,684 | 1/1968 | Davenport | 254/131 |
| 4,191,360 | 3/1980 | Morrison | 254/131 |

*Primary Examiner*—J. J. Swann
*Attorney, Agent, or Firm*—William Nitkin

[57] ABSTRACT

A roof-opening device for use by fire fighters to open a vent hole for the venting of gases from a burning building containing plywood panels attached to roofing beams, such device having a shaft with a handle at the top end thereof and a transversely positioned fulcrum member at the bottom end thereof and a pair of tines extending outwardly from the fulcrum member, the tines spaced apart from one another a distance to pass over on both sides of a roofing beam after the tines are passed through a slot cut in the roof generally perpendicular to such roofing beams such that the tines when manuevered downward through the slot on each side of the roofing beam can lift the plywood panel attached thereto in incremental steps as the fulcrum member is moved along the roofing beam to separate the plywood panel from the roofing beam and open up a vent hole.

4 Claims, 3 Drawing Sheets

ROOF OPENER AND METHOD FOR THE VENTING OF STRUCTURES BY FIRE FIGHTERS

BACKGROUND OF THE INVENTION

1. Field of the Invention

The device of this invention is a roof-opening device and method for use by fire fighters and more particularly relates to a tool having a shaft with a handle positioned at the top end of the shaft and a fulcrum member transversely positioned at the other end of the shaft with a pair of spaced-apart tines extending from the fulcrum member which tines, when the device is in use, are forced into a slot cut into the roof of a burning building for the lifting and removal of panels of roofing plywood.

2. Description of the Prior Art

When fighting fires, it is necessary to vent the building that is burning. Such venting occurs at the roof to allow the escape of gases. If these gases are not allowed to escape, they can build up and an explosion could occur which could seriously injure or kill firemen who are within the building fighting the fire. Presently firemen labor strenuously with axes to open the roof of a burning building by chopping through the roof material. Frequently the roof material is made up of 4×8 ft panels of plywood covered with other layers of material such as tar paper or shingles. Chopping through such roof panels with axes can take as long as three to five minutes to open up a sufficiently large vent opening. Also chopping a vent causes a great deal of damage as the plywood panels are broken and splintered into pieces, and the roof must later be recovered be secure the building after the fire is put out.

SUMMARY OF THE INVENTION

It is an object of this invention to provide a useful tool and method to enable fire fighters to quickly vent a burning building.

It is a further object of this invention to minimize the damage done to the roof of a burning building by the venting of the roof.

The device of this invention consists of an elongated shaft with an open centered rectangular handle extending at an angle to the shaft and a pair of tines spaced apart a specific distance extending from a cylindrical fulcrum member transversely mounted at the end of the shaft with reinforcement members positioned between the bottom of the fulcrum member and the bottom of the tines. The tines are spaced apart a distance so that they can pass on both sides of a roof support beam as will be described below.

To vent the roof of a burning building, fire fighters first utilize a portable chainsaw to cut a slot across a section of the roof generally perpendicular to the roof beams extending across at least one of the sections of plywood paneling. This cutting through the upper layers of roofing material at the same time makes an elongated slot within a panel or several panels of the roofing plywood. The roofing plywood is usually nailed down with many large nails and is very difficult to remove by axes as practiced in the prior art as described above. After a slot has been cut in the roof, a fire fighter, using the device of this invention, inserts the pointed ends of the tines into the slot and forces the device therein until the fulcrum member or reinforcement members of the device can be pressed against the roof. Force is then applied downward on the handle, pushing the handle down and the tines upward. The tines will pass under the plywood and when the handle is pushed down, the tines will lift the plywood upward. A pry bar, if desired, can be inserted under the lifted plywood by a second fire fighter to retain the plywood in its somewhat lifted position and the roof opener of this invention can then be advanced forward somewhat with its tines then positioned on both sides of a roofing beam and pushed downward, against forcing the plywood panel up further. The roof opener of this invention is then pushed forward so that its fulcrum member rests on the roof beam and the handle is again pushed downward, lifting more of the panel. The roof opener is then moved further forward on the roofing beam and pushed downward again, forcing more of the panel upwards. The cycle of the advancement of the roof opener and the lifting of the roof panel continues until the panel is totally lifted and separated from the roof. A prybar can be used by a second fire fighter to help hold the panel away from the roof as the roof opener is advanced to a more forward positioning.

By the use of the roof opener of this invention a roof can be opened often in under 20 seconds that might take 3–5 minutes to vent by prior art means. The method of using the device of this invention to vent the roof of a burning building represents a tremendous improvement over the use of axes used in the prior art and constitutes a significant advance in the art of fire fighting equipment.

DESCRIPTION OF THE PREFERRED EMBODIMENT(S)

Figure 1:
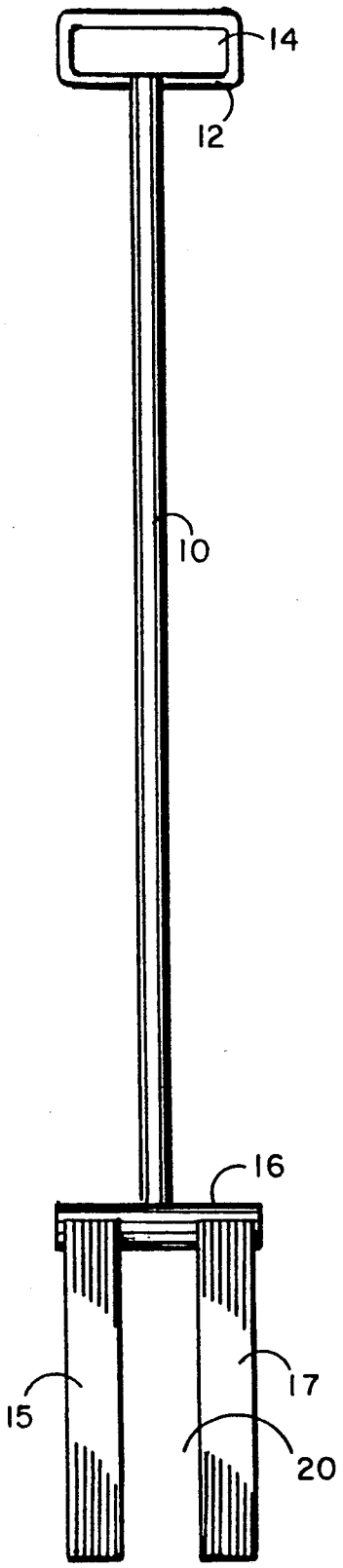
FIG. 1 illustrates a front elevational view of the roof opener of this invention.
Figure 2:
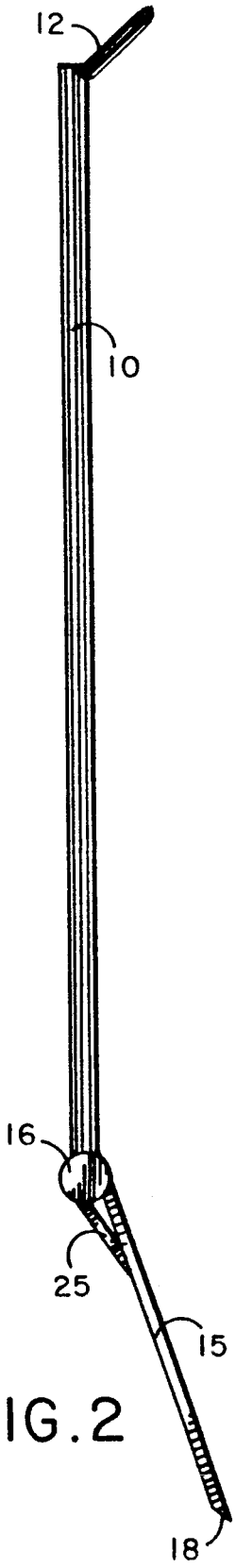
FIG. 2 illustrates a left side view of the roof opener of FIG. 1.
Figure 2A:
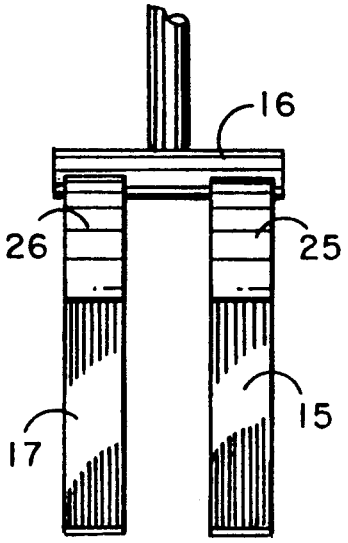
FIG. 2*a* illustrates a rear view of the lower end of the roof opener.
Figure 3:
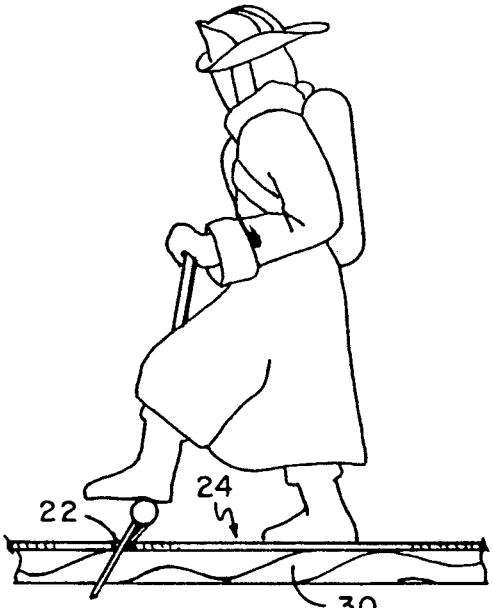
FIG. 3 illustrates the roof opener being inserted into a slot cut in the roof of a burning building.
Figure 4:
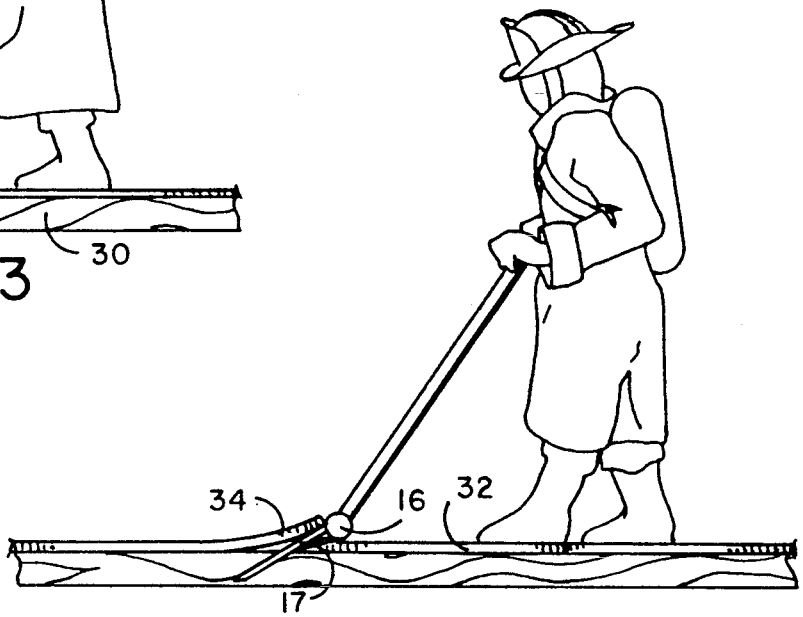
FIG. 4 illustrates the roof opener lifting up the roof panel.
Figure 5:
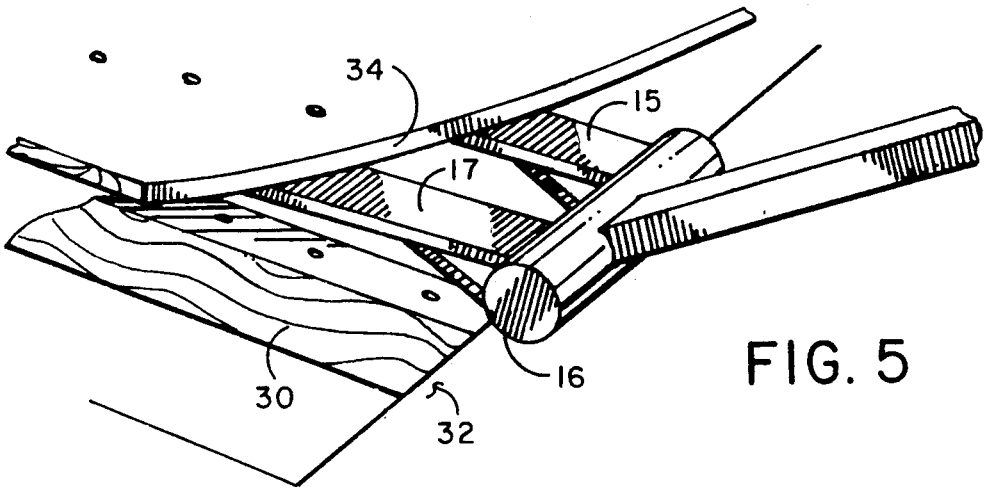
FIG. 5 illustrates an enlarged view of the roof opener lifting up a roof panel, showing the tines on either side of a roof beam.

The roof opener of this invention, as seen in FIG. 1, can be made of steel or equivalent strong material and consists of an elongated shaft 10 which in a preferred embodiment can be approximately 36 inches in length. Positioned at the top end of this shaft is handle 12 which in a preferred embodiment can be an open rectangular member welded to shaft 10 or attached by equivalent means. Opening 14 in the center of handle 12 allows for the secure gripping thereof. Handle 12 in a preferred embodiment is disposed at an angle of approximately 135 degrees, as seen in FIG. 2, to the longitudinal axis of shaft 10 which handle angle has been found to provide good leverage as the handle is being pushed downward while the device is levering a plywood roof panel upward off the roof. At the other end of shaft 10 is fulcrum member 16 which can be generally cylindrical in shape and has extending from its upper top portion at an angle of approximately 20 degrees to the longitudinal axis of shaft 10 a pair of spaced-apart tines 15 and 17. The tines can be approximately 1.7 inches in width and approximately 10 inches in length in a preferred embodiment. The tines at their ends 18 are beveled at an angle of approximately 30 degrees from their top side to a point, as seen in FIG. 2, and are mounted on an upper portion of fulcrum member 16 and spaced apart approximately 2.5 inches from one another, forming roof beam receipt opening 20 seen in FIG. 1. The distance between the tines must be greater than the width of the roofing beam so that the tines can be passed down over the roofing beam with one tine on each side of the roofing beam such as roofing beam 30 in FIG. 5. Handle 12 is maneuvered downward by grasping the handle and first inserting the tines into slot 22 cut by a chainsaw into roof 24 as seen in FIG. 3. As seen in FIG. 2*a* fulcrum member 16 and attached reinforcement members 25 and 26, which extend respectively from the bottom portion of fulcrum member 16 to under each tine 15 and 17, are pressed down on a portion of the roof first, causing the tines to lift the end of the nailed-down plywood panel. The reinforcement members extend out part way down the tines to an intermediate position to allow the tine tips to be free of structure so that they can easily be inserted into slot 22 cut in the roof. The reinforcement members act as a lever base against rear roof panel 32 on the other side of the slot from plywood panel 34 which is being lifted as seen in FIG. 5. As the plywood panel is lifted, it can be retained in place by a pry bar, if desired, which can be inserted and wedged under the plywood panel by a second fire fighter. Fulcrum member 16 is advanced along roof beam 30 with the tines positioned one on each side of beam 30, and handle 12 can be forced downward again to lift plywood panel 34 further upward as handle 12 is moved downward. By advancing the roof opener of this invention along roof beam 30 with the tines on both sides thereof, a fire fighter can quickly lift the roof panel incrementally and release the many long nails that hold it down. In this way the entire roof panel can be removed in one section which operation is highly advantageous because when the fire is extinguished and it is desired to cover and secure the building, the removed plywood panel can be repositioned over the opening and banged downward with the roof opener of this invention into its original position on the roof. Repositioning of the original plywood panel saves fire fighters much time in recovering a roof which has been so opened for venting.

Figure 6:
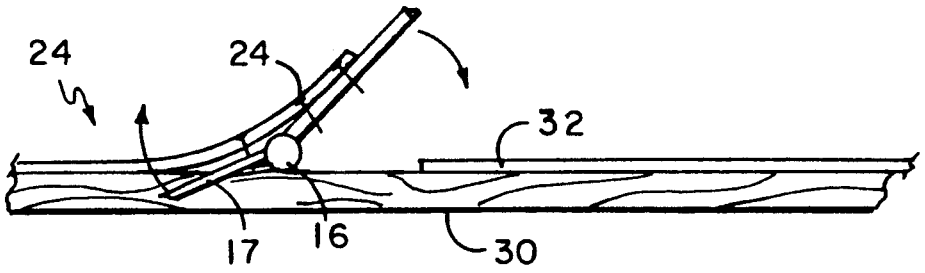
FIG. 6 illustrates a cutaway side view of the roof lifting up the roof panel as it advances down a rood beam.

FIG. 6 illustrates a side view of the roof opener's fulcrum member being advanced along roof beam 30 showing fulcrum member 16 resting on roof beam 30 to lever plywood panel 34 upwards.

Although the present invention has been described with reference to particular embodiments, it will be apparent to those skilled in the art that variations and modifications can be substituted therefor without departing from the principles and spirit of the invention.

I claim:

1. A roof-opening device for use by fire fighters to open a vent hole for the venting of gases from a burning building of the type having a roof of underlying plywood panels attached by nails to roofing beams wherein a saw cut has been made through said panels, comprising:

a shaft having a longitudinal axis and a top end and a bottom end, said shaft having a handle defined at said top end;

a fulcrum member positioned transversely to said shaft at said bottom end;

a pair of tines attached to and extending outward from said fulcrum member, said tines spaced apart in parallel relationship to one another a distance wider than the width of one of said roofing beams wherein said fulcrum member has an upper top portion and a bottom portion and said tines extend from said upper top portion of said fulcrum member, said device further including a pair of reinforcement members extending from the bottom portion of said fulcrum member to an intermediate position on said tines, respectively; and wherein said tines are flat planar members approximately 10 inches in length and approximately 1.75 inches in width, said tines thin enough to fit in said saw cut, said tines spaced approximately 2.5 inches apart from one another for positioning around a roof beam of said building for leveraging and forcing a roof panel upward from said roof beam to release the nails that hold the panel to said beam by pulling them out of said roof beam.

2. The device of claim 1 wherein said tines extend from the upper top portion of said fulcrum member at an angle of approximately 20 degrees to the axis of said shaft.

3. The device of claim 2 wherein said shaft is approximately 36 inches in length.

4. The device of claim 3 wherein said handle extends from said shaft at an angle of approximately 135 degree to the longitudinal axis of said shaft.

* * * * *